US008831496B2

(12) United States Patent
Ishida

(10) Patent No.: US 8,831,496 B2
(45) Date of Patent: Sep. 9, 2014

(54) FUSER UNIT

(75) Inventor: Kei Ishida, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/361,180

(22) Filed: Jan. 30, 2012

(65) Prior Publication Data

US 2012/0195651 A1 Aug. 2, 2012

(30) Foreign Application Priority Data

Jan. 31, 2011 (JP) ..... 2011-017610

(51) Int. Cl.
*G03G 15/20* (2006.01)

(52) U.S. Cl.
CPC .... *G03G 15/2064* (2013.01); *G03G 2215/2035* (2013.01)
USPC ..... 399/329

(58) Field of Classification Search
USPC ..... 399/329, 333
See application file for complete search history.

(56) References Cited

U.S. PATENT DOCUMENTS

| | | | | |
|---|---|---|---|---|
| 5,709,765 | A * | 1/1998 | Herbert et al. | 156/293 |
| 6,505,028 | B1 | 1/2003 | Yoda et al. | |
| 7,076,196 | B2 * | 7/2006 | Takahashi et al. | 399/328 |
| 7,457,575 | B2 | 11/2008 | Tsunoda | |
| 2005/0220510 | A1 * | 10/2005 | Tsunoda | 399/329 |

FOREIGN PATENT DOCUMENTS

| | | | | |
|---|---|---|---|---|
| JP | 05-019651 | | 1/1993 | |
| JP | 7199695 | A | 8/1995 | |
| JP | 7-281549 | A | 10/1995 | |
| JP | 2001-075381 | | 3/2001 | |
| JP | 2001-075405 | | 3/2001 | |
| JP | 2002-062751 | * | 2/2002 | B29C 41/04 |
| JP | 2002-062751 | A | 2/2002 | |
| JP | 3265853 | | 3/2002 | |
| JP | 2003-021977 | | 1/2003 | |
| JP | 2003-307950 | | 10/2003 | |
| JP | 2005-316364 | | 11/2005 | |
| JP | 2006-072218 | | 3/2006 | |
| JP | 2007-011192 | | 1/2007 | |
| JP | 2008-122580 | * | 5/2008 | B65G 15/20 |
| JP | 2008-122580 | A | 5/2008 | |
| JP | 2010-122338 | A | 6/2010 | |

OTHER PUBLICATIONS

JP Office Action dtd Jan. 22, 2013, JP Appln. 2011-017610, English translation.

* cited by examiner

*Primary Examiner* — Clayton E Laballe
*Assistant Examiner* — Kevin Butler
(74) *Attorney, Agent, or Firm* — Banner & Witcoff, Ltd.

(57) ABSTRACT

A fuser unit includes a cylindrical member that has flexibility; a nip member that is disposed to slidingly contact with an inner surface of the cylindrical member; and a backup member that is driven by a driving force and configures a nip region between the backup member and the cylindrical member on the nip member, wherein the cylindrical member includes folded-back portions formed at outer sides of a recording-sheet conveyance region in a recording-sheet width direction by folding back entire circumferences of both ends of the cylindrical member outward.

6 Claims, 6 Drawing Sheets

FUSER UNIT

CROSS-REFERENCE TO RELATED APPLICATION

This application claims priority from Japanese Patent Application No. 2011-017610 filed on Jan. 31, 2011, the entire subject matter of which is incorporated herein by reference.

TECHNICAL FIELD

This disclosure relates to a fuser unit for fixing a transferred developer image on a recording sheet by heat.

BACKGROUND

As a fuser unit for an electrographic image forming apparatus, it is known that a fuser unit which includes a cylindrical fixing film, a heater disposed in the fixing film, and a nip plate which configures a nip part between a pressing roller and the fixing film on the nip plate. Specifically, in the fuser unit, the pressing roller is driven by a motor, and the fixing film is driven to rotate by the pressing roller.

SUMMARY

However, in the above-mentioned technology, when a recording sheet passes between the fixing film and the pressing roller, a driving force from the pressing roller may not be sufficiently transmitted to the fixing film, so that the traveling performance of the fixing film may be degraded (the fixing film slips). Like this, if the fixing film slips, the developer image cannot be firmly fixed on the recording sheet. Further, since the fixing film is very thin, its edge portions are easily damaged, and the fixing film may crack or be broken due to contact with surrounding components.

In view of the above, this disclosure provides a fuser unit which is capable of suppressing slipping of a fixing film, so that a developer image is firmly fixed on a recording sheet, and in which it is difficult for edge portion of the fixing film to be damaged.

With considering the above, a fuser unit of this disclosure comprises a cylindrical member that has flexibility; a nip member that is disposed to slidingly contact with an inner surface of the cylindrical member; and a backup member that is driven by a driving force and configures a nip region between the backup member and the cylindrical member on the nip member, wherein the cylindrical member includes folded-back portions formed at outer sides of a recording-sheet conveyance region in a recording-sheet width direction by folding back entire circumferences of both ends of the cylindrical member outward.

According to the fuser unit having the above-mentioned configuration, both ends of the cylindrical member are folded outward so that steps are to be formed, and the steps are run into the backup member. Therefore, it is possible to suppress the slipping of the cylindrical member. Further, since the edges of a material of the cylindrical member which are fragile parts are not located at the open ends, it is possible to suppress the cylindrical member from being damaged.

According to this disclosure, since it is possible to suppress the slipping of the cylindrical member, it is possible to reliably fix a developer image on a recording sheet. Further, it is possible to suppress the end portions of the cylindrical member from being damaged.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Hereinafter, an illustrative embodiment of this disclosure will be described in detail with reference to appropriate drawings. In the following description, a schematic configuration of a laser printer 1 (an image forming apparatus) having a fuser unit 100 according to an illustrative embodiment of this disclosure will be described, and then a detailed configuration of the fuser unit 100 will be described.

<Schematic Configuration of Laser Printer>

Figure 1:
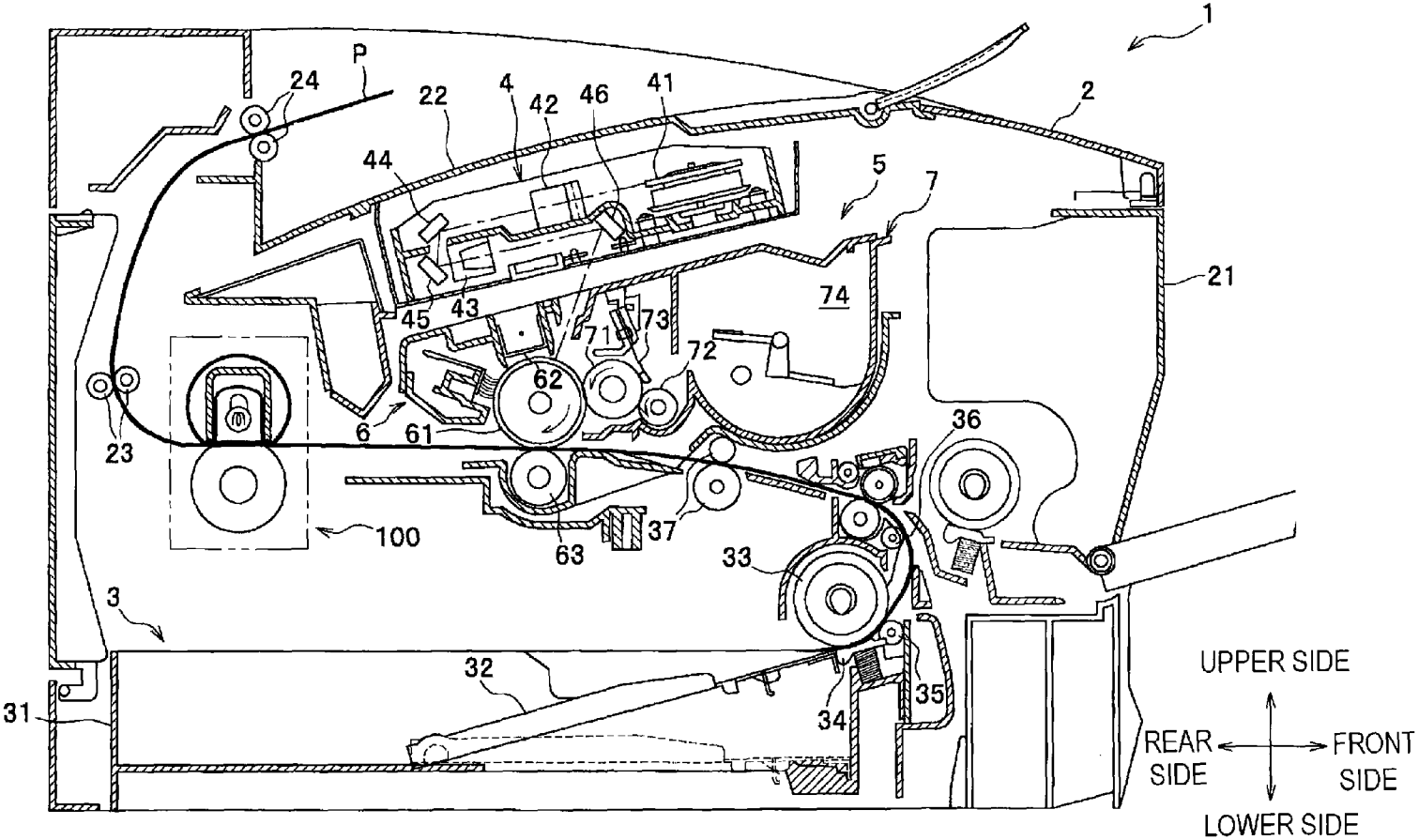
FIG. 1 is a sectional side view illustrating a laser printer according to an illustrative embodiment of this disclosure.

As shown in FIG. 1, the laser printer 1 mainly includes a paper feeding unit 3 for feeding a sheet P as an example of a recording sheet, an exposing unit 4, a process cartridge 5 for transferring a toner image (developer image) onto the sheet P, and a fuser unit 100 for fixing the toner image on the sheet P by heat, which are provided in a main housing 2.

In the below descriptions, the directions are described on the basis of a user who uses the laser printer 1. That is, the right side of FIG. 1 is referred to as the 'front', the left side is referred to as the 'rear', the front side is referred to as the 'left side' and the back side is referred to as the 'right side.' Also, the upper-lower direction of FIG. 1 is referred to as the 'upper-lower.'

The paper feeding unit 3 is provided at the lower part of the main housing 2 and mainly includes a paper feed tray 31 for accommodating sheets P, a paper pressing plate 32 for holding up the front side of each sheet P, a paper feeding roller 33, a paper feeding pad 34, paper-dust removing rollers 35 and 36, and registration rollers 37. The sheets P in the paper feed tray 31 are brought near to the paper feeding roller 33 by the paper pressing plate 32, and are separated one by one by the paper feeding roller 33 and the paper feeding pad 34, and the sheets P are conveyed toward the process cartridge 5 through the paper-dust removing rollers 35 and 36 and the registration rollers 37.

The exposing unit 4 is disposed at the upper part in the main housing 2 and mainly includes a laser emission unit (not shown), a polygon mirror 41 which is driven to rotate, lenses 42 and 43, and reflective mirrors 44, 45, and 46. In the exposing unit 4, a laser beam (see a chain line) based on image data is emitted from the laser emission unit, is reflected by or passes through the polygon mirror 41, the lens 42, the reflecting mirrors 44 and 45, the lens 43, and the reflecting mirror 46, in their order, and the laser beam is irradiated onto a surface of a photosensitive drum 61 to scan the surface of the photosensitive drum 61 at high speed.

The process cartridge 5 is disposed below the exposing unit 4 and is configured to be detachably mounted to the main housing 2 from an opening when a front cover 21 provided to the main housing 2 is open. The process cartridge 5 includes a drum unit 6 and a developing unit 7.

The drum unit 6 mainly includes the photosensitive drum 61, a charger 62, and a transfer roller 63. Also, the developing unit 7 is configured to be detachably mounted to the drum unit 6 and mainly includes a developing roller 71, a supply roller 72, a layer-thickness regulating blade 73, and a toner container 74 for containing toner (developer).

In the process cartridge 5, the surface of the photosensitive drum 61 is uniformly charged by the charger 62, and then the surface is exposed by high-speed scanning with the laser beam from the exposing unit 4, so that an electrostatic latent image based on the image data is formed on the photosensitive drum 61. Further, the toner in the toner container 74 is supplied to the developing roller 71 through the supply roller 72, and enters into a gap between the developing roller 71 and the layer-thickness regulating blade 73, in order to be held as a thin layer having a constant thickness on the developing roller 71.

The toner held on the developing roller 71 is supplied from the developing roller 71 to the electrostatic latent image formed on the photosensitive drum 61. Therefore, the electrostatic latent image is visualized, that is, a toner image is formed on the photosensitive drum 61. Then, a sheet P is carried between the photosensitive drum 61 and the transfer roller 63, so that the toner image on the photosensitive drum 61 is transferred onto the sheet P.

The fuser unit 100 is provided on the rear side relative to the process cartridge 5. The transferred toner image (toner) on the sheet P passes through the fuser unit 100, so that the toner image is fixed on the sheet P by heat. The sheet P having the toner image fixed thereon by heat is discharged onto a paper discharge tray 22 by conveyance rollers 23 and 24.

<Detailed Configuration of Fuser Unit>

Figure 2:
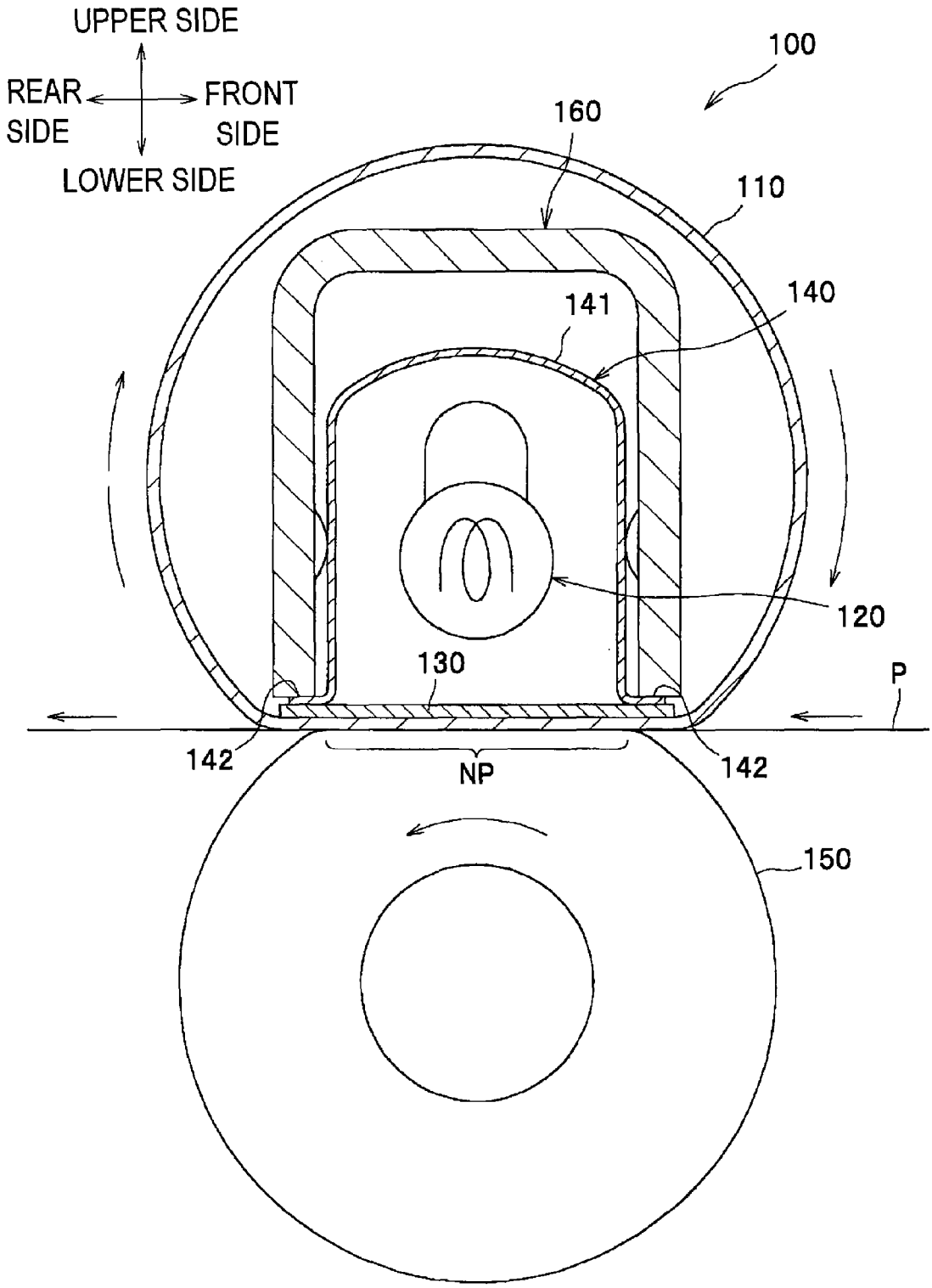
FIG. 2 is a view illustrating a schematic configuration of a fuser unit according to the illustrative embodiment of this disclosure.
Figure 3:
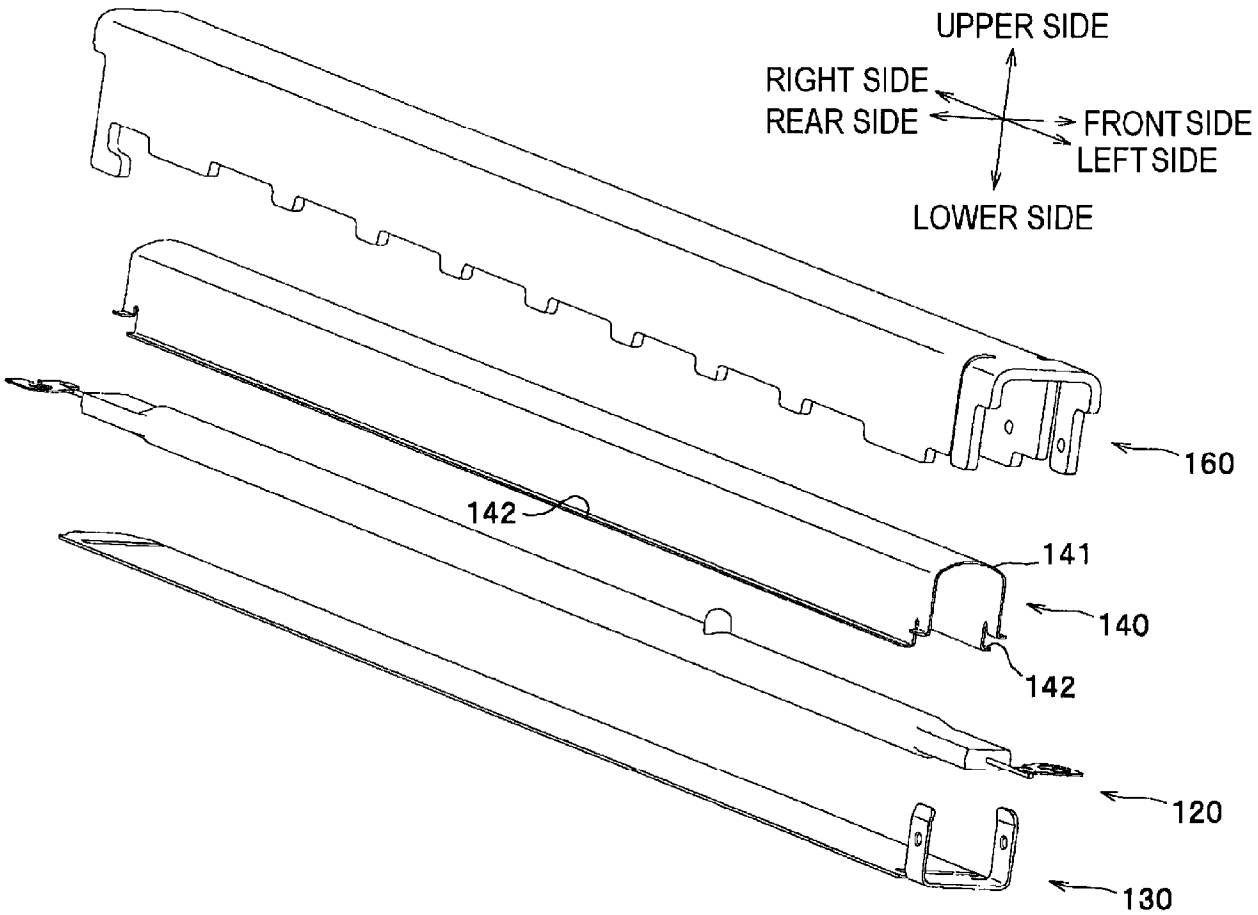
FIG. 3 is a perspective view illustrating a halogen lamp, a nip plate, a reflective plate, and a stay member.

As shown in FIGS. 2 and 3, the fuser unit 100 includes a fixing film 110 which is an example of a cylindrical member, a halogen lamp 120 which is an example of a heating element, a nip plate 130 which is an example of a nip member, a reflective plate 140, a pressing roller 150 which is an example of a backup member, and a stay member 160.

Figure 5:
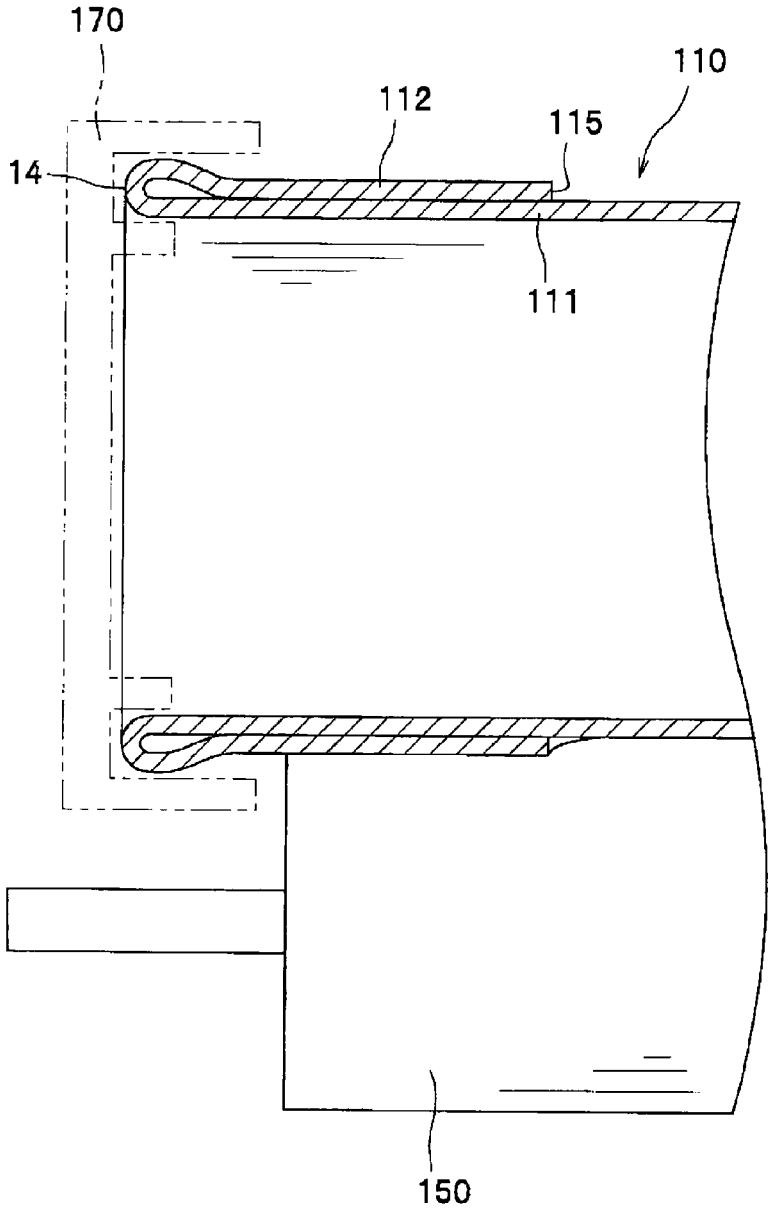
FIG. 5 illustrates a cross-sectional view of the fuser unit.

The fixing film 110 is an endless (cylindrical) film having heat resistance and flexibility, and the rotation of both end portions of the fixing film 110 is guided by guide members 170 (see FIG. 5). The fixing film 110 is configured to slidingly contact with the nip plate 130 through grease. According to the materials of the fixing film 110 and the nip plate 130, the grease may not be necessarily applied. A configuration of the fixing film 110 will be described below in detail.

The halogen lamp 120 is a known heating element which heats the nip plate 130 and the fixing film 110 so as to heat the toner on the sheet P, and is disposed inside the fixing film 110 with predetermined gaps from the inner sides of the fixing film 110 and the nip plate 130.

The nip plate 130 is a plate-shaped member which receives radiant heat from the halogen lamp 120, and is disposed to slidingly contact with an inner surface of the cylindrical fixing film 110. Further, the nip plate 130 transfers the radiant heat received from the halogen lamp 120 to the toner on the sheet P through the fixing film 110.

The nip plate 130 is made of, for example, an aluminum plate having heat conductivity higher than that of the stay member 160 made of steel (to be described below), in a planar shape. On an upper surface of the nip plate 130, black paint may be applied, or a heat absorbing member may be provided. In this case, it is possible to efficiently absorb the radiant heat from the halogen lamp 120.

The reflective plate 140 is a member which reflects the radiant heat from the halogen lamp 120 (mainly radiant heat radiated in the front-rear direction and upward) toward the nip plate 130 (the upper surface of the nip plate 130), and is disposed inside the fixing film 110 so as to surround the halogen lamp 120 with predetermined gaps from the halogen lamp 120.

This reflective plate 140 concentrates the radiant heat from the halogen lamp 120 on the nip plate 130. Therefore, it is possible to effectively use the radiant heat from the halogen lamp 120 and thus quickly heat the nip plate 130 and the fixing film 110.

The reflective plate 140 is formed by bending, for example, an aluminum plate having high reflectivity for infrared rays and far infrared rays, almost into a U shape in a cross-sectional view. More specifically, the reflective plate 140 mainly includes a reflective portion 141 having a bent shape (almost a U shape in cross-sectional view), and flange portions 142 extending outward from both end portions of the reflective portion 141 in the front-rear direction. In order to increase heat reflectivity, the reflective plate 140 may be formed with, for example, a mirrored aluminum plate.

The pressing roller 150 is an elastically deformable member and is disposed below the nip plate 130. Further, the pressing roller 150 is elastically deformed, and in this state, the fixing film 110 is nipped between the pressing roller 150 and the nip plate 130, so that a nip region NP is formed between the pressing roller 150 and the fixing film 110.

The pressing roller 150 is configured to rotate by a driving force transmitted from a motor (not shown) provided in the main housing 2. If the pressing roller 150 rotates, a frictional force to the fixing film 110 rotates the fixing film 110. Therefore, the sheet P having the toner image transferred thereon is conveyed between the pressing roller 150 and the heated fixing film 110 (the nip region NP) so that the toner image (toner) is fixed by heat.

The stay member 160 is a member which supports both end portions 131B of the nip plate 130 in the front-rear direction, through the flange portions 142 of the reflective plate 140, so as to secure the rigidity of the nip plate 130. The stay member 160 has a shape (almost a U shape in a cross-sectional view) according to a shape of an outer surface of the reflective plate 140 (reflective portion 141), and is disposed to cover the reflective plate 140. This stay member 160 is formed by bending, for example, a steel plate having relatively high rigidity, almost into a U shape in a cross-sectional view.

<Structure of Fixing Film>

Figure 4:
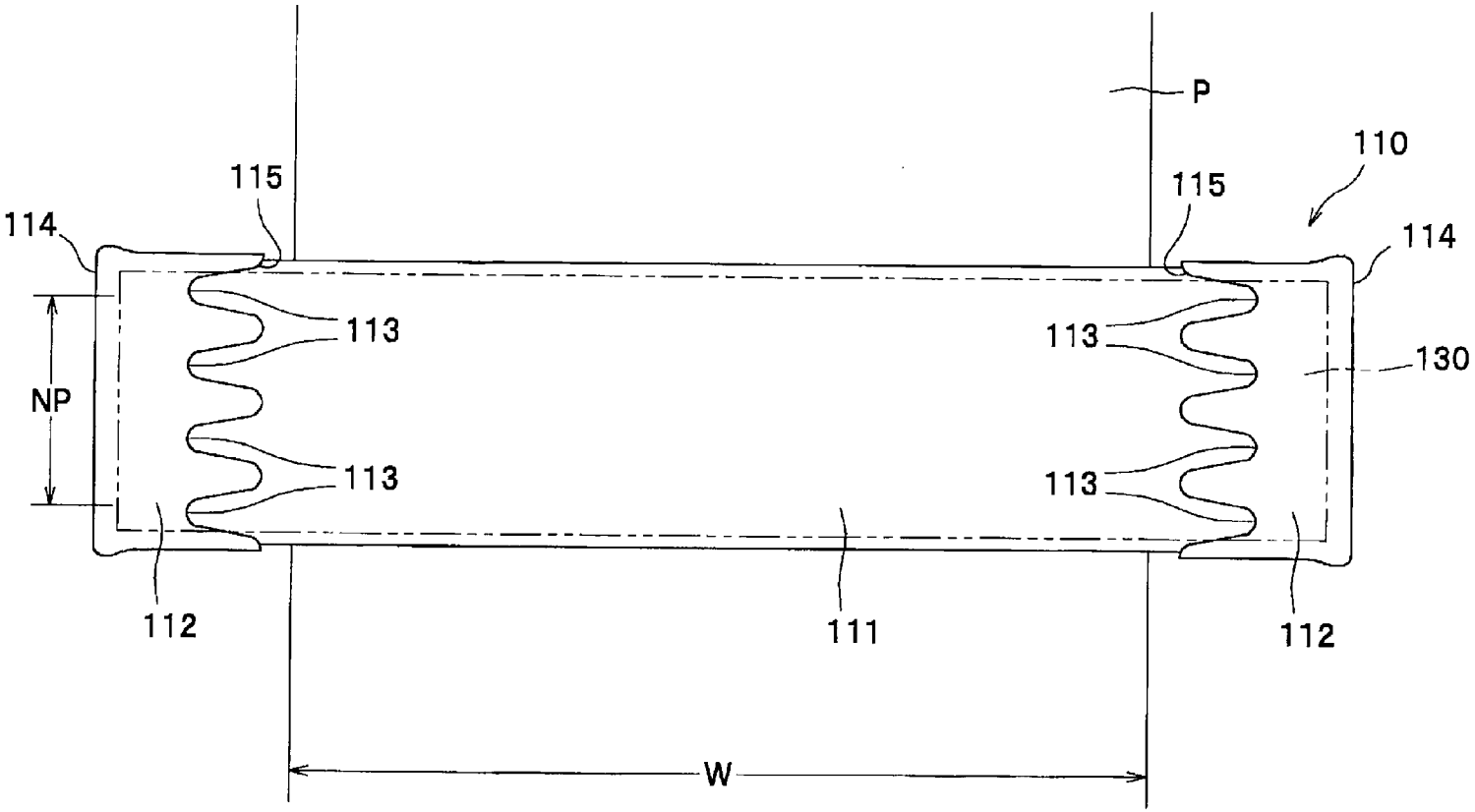
FIG. 4 illustrates a top view of the fuser unit.

As shown in FIGS. 4 and 5, the fixing film 110 includes a main body 111 of the fixing film, and folded-back portions 112 formed at the outer sides of a paper conveyance region W in a paper width direction by folding the outer circumferences of both ends outward. Here, the paper conveyance region W represents a conveyance region of a sheet of the maximum size of an image which can be formed by the laser printer 1.

Specifically, as shown in FIG. 5, end portions of the fixing film 110 are gently folded back so that spaces are formed between the folded-back portions 112 and the main body 111 of the fixing film facing the folded-back portions 112, and the folded-back portions 112 overlap the outer circumference surface of the main body 111 of the fixing film. As described above, since the end portions of the fixing film 110 are gently folded back, the end portions of the fixing film 110 are rounded with a large radius of curvature.

As shown in FIG. 4, the folded-back portions 112 have a plurality of substantially U-shaped notches 113 (cut-off portions) formed at inner edges 115 in the paper width direction by laser machining. Therefore, at contact surfaces of the folded-back portions 112 with the pressing roller 150, concaves and convexes are formed in a thickness direction. Further, in order to suppress the folded-back portions 112 from rising up from the main body 111 of the fixing film, it is preferable to form the notches 113 so that the notches 113 do not reach open ends 114 of the fixing film 110.

The plurality of notches 113 are arranged in a circumferential direction with one or more pitches locating at the nip region NP. Therefore, when the fixing film 110 rotates, it is possible to always run the concaves and convexes of the folded-back portions 112 into the pressing roller 150.

Further, at the left and right folded-back portions 112, the notches 113 are formed so that the left notches 113 and the right notches 113 face each other and have the same size. Therefore, a force from the pressing roller 150 is uniformly applied to the left and right of the fixing film 110. As a result, it is possible to suppress obliquely rotating of the fixing film 110.

For example, the fixing film 110 may be manufactured as follows.

First, a seamless belt is formed by extrusion molding, and a plurality of portions of both ends of the seamless belt is cut off by laser machining, so that the plurality of notches 113 is formed. Then, the entire circumferences of both ends of the seamless belt are folded back by a curling process, so that the folded-back portions 112 overlap the main body 111 of the fixing film as shown in FIG. 5. As described above, it is possible to manufacture the fixing film 110 having the folded-back portions 112 with the plurality of notches 113.

In the fuser unit 100 configured as described above, the sheet P having the toner image transferred thereon is conveyed between the pressing roller 150 and the heated fixing film 110 (the nip region NP), so that the toner image (toner) is fixed by heat. In this case, even if the frictional force between the fixing film 110 and the pressing roller 150 is reduced by the conveyance of the sheet P, the folded-back portions 112 are pressed against the pressing roller 150 so that the concave-convex portions are run into the pressing roller 150. Therefore, the driving force of the pressing roller 150 is reliably transmitted to the fixing film 110, and thus it is possible to suppress the slipping of the fixing film 110.

According to the above-mentioned configuration, in the present illustrative embodiment, it is possible to achieve the following effects.

Since both ends of the fixing film 110 are folded outward so that the steps are formed and the steps are run into the pressing roller 150, even when the sheet P is being conveyed between the fixing film 110 and the pressing roller 150, it is possible to suppress the slipping of the pressing roller 150. Further, since the edges of a material of the fixing film 110 which are fragile parts are not positioned at the open end, it is possible to suppress the fixing film 110 from being damaged.

Further, since the concaves and convexes are formed at the contact surfaces of the folded-back portions 112 with the pressing roller 150, it is possible to strengthen a gripping force between the fixing film 110 and the pressing roller 150 at the folded-back portions 112. Therefore, it is possible to reliably transmit the driving force of the pressing roller 150 to the fixing film 110.

Furthermore, since the concaves and convexes of the surfaces of the folded-back portions 112 are formed by the notches 113 formed at the inner edges 115 of the folded-back portions 112 in the paper width direction, it is possible to simply form the concaves and convexes by laser machining on the seamless belt.

Moreover, since the notches 113 are formed to not reach the outer edges of the fixing film 110 in the paper width direction, even if the folded-back portions 112 are not fixed to the main body 111 of the fixing film by an adhesive or the like, it is possible to suppress rising of the folded-back portions 112 from the fixing film 110.

Also, since the notches 113 are arranged in a pitch, in which at least one of the notches is positioned at the nip region NP, even if the fixing film 110 rotates, it is possible to always run the concaves and convexes into the pressing roller 150.

The left notches 113 and the right notches 113 are formed to face each other in the paper width direction so that the force from the pressing roller 150 is uniformly applied to the left and right of the fixing film 110. Therefore, it is possible to suppress the obliquely rotating of the fixing film 110.

The end portions of the fixing film 110 are gently folded back so that the spaces are formed between the folded-back portions 112 and the fixing film 110 facing the folded-back portions 112. Therefore, the fixing film 110 may not damage other components such as the guide members 170.

Although the illustrative embodiment of this disclosure has been described above, this disclosure is not limited to the above-mentioned illustrative embodiment. The specific configuration may be appropriately modified within the scope of this disclosure.

In the above-mentioned illustrative embodiment, the notches 113 are formed almost in a U shape. However, this disclosure is not limited thereto. For example, like a first modification shown in FIG. 6A, inner edges of folded-back portions 212 in the paper width direction may be cut off in a squared U shape, so that notches 213 are formed. Even in this fixing film 210, it is possible to achieve the same effects as those of the above-mentioned illustrative embodiment.

Figure 6A:
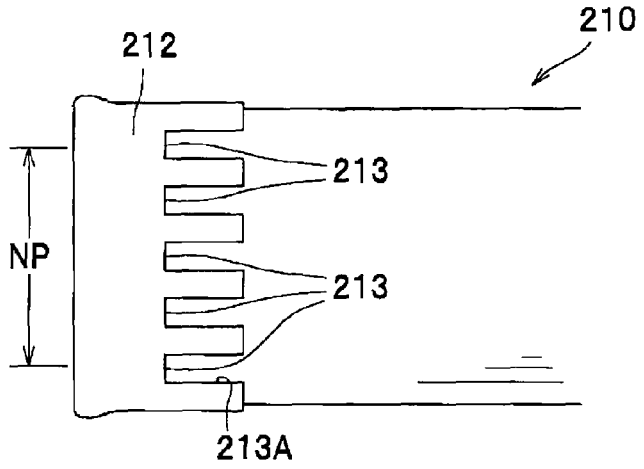
FIG. 6A is a view illustrating a fixing film according to a first modification.
Figure 6B:
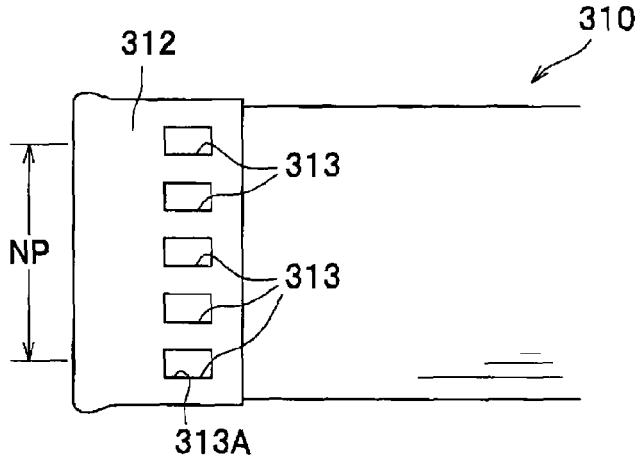
FIG. 6B is a view illustrating a fixing film according to a second modification.

In the above-mentioned illustrative embodiment, as notches, the notches 113 have been exemplified. However, this disclosure is not limited thereto. For example, like a second modification shown in FIG. 6B, the notches may be holes 313 formed in folded-back portions 312 in a thickness direction. Even in this fixing film 310, it is possible to achieve the same effects as those of the above-mentioned illustrative embodiment. Also, it is preferable that the notches preferably have edge portions 213A or 313A along the paper width direction, as shown in FIG. 6A or 6B. The edge portions 213A or 313A strengthen the gripping force between the fixing film 110 and the pressing roller 150 at the folded-back portions 212 or 312, as compared to a case where the edge portions are oblique to the paper width direction.

Figure 6C:
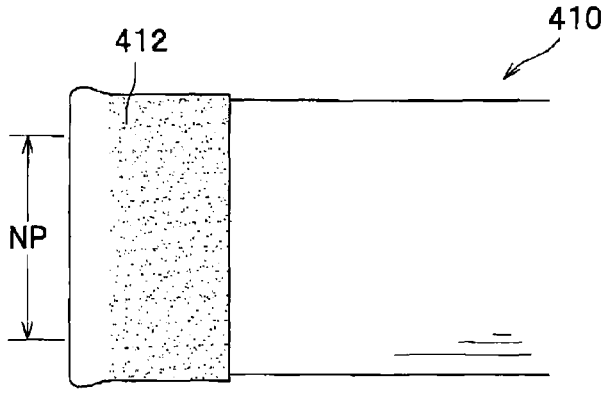
FIG. 6C is a view illustrating a fixing film according to a third modification.

The concaves and convexes are formed by the notches of the folded-back portions 112. However, this disclosure is not limited thereto. For example, like a third modification shown in FIG. 6C, the surfaces of folded-back portions 412 may be roughened by a roughening process, so as to have concaves and convexes. Even in this fixing film 410, it is possible to achieve the same effects as those of the above-mentioned illustrative embodiment.

In the above-mentioned illustrative embodiment, the notches 113 are formed by the laser machining. However, this disclosure is not limited thereto. The notches 113 may be formed by pressing. In this case, in order to suppress the pressing roller 150 from being damaged, it is preferable to process burrs to direct the burrs toward the inner side of the fixing film 111.

In the above-mentioned illustrative embodiment, as the method of manufacturing the fixing film 110, the process of manufacturing the seamless belt, forming the notches 113, and folding the end portions outward has been exemplified. However, this disclosure is not limited thereto. For example, the fixing film 110 may be manufactured by rolling up a sheet having notches 113 in a cylindrical shape. Specifically, first, at one end portion of one sheet and another end portion facing the one end portion, the notches 113 are formed. Then, the other end portions of the sheet without any notches 113 are bonded to each other, thereby manufacturing a cylindrical seamed belt. Next, the end portions with the notches 113 are folded outward.

In the above-mentioned illustrative embodiment, the notches 113 are formed at the folded-back portions 112. However, this disclosure is not limited thereto. Any cut-off portions such as the notches 113 may not be provided to the folded-back portions 112. Even if those notches are not provided, since the steps formed by folding both ends of the fixing film 110 outward are run into the pressing roller 150, the gripping force between the fixing film 110 and the pressing roller 150 strengthens. Therefore, it is possible to suppress the slipping of the fixing film 110.

In the above-mentioned illustrative embodiment, as the nip member, the plate-shaped nip plate 130 has been exemplified. However, this disclosure is not limited thereto. For example, a thick member having a shape other than the plate shape may be used.

In the above-mentioned illustrative embodiment, as the backup member, the pressing roller 150 has been exemplified. However, this disclosure is not limited thereto. For example, the backup member may be a belt-shaped pressing member or the like.

In the above-mentioned illustrative embodiment, as the recording sheet, the sheet P such as plain paper and card has been exemplified. However, this disclosure is not limited thereto. For example, the recording sheet may be an OHP sheet.

In the above-mentioned illustrative embodiment, as the image forming apparatus having the fuser unit 100 of this disclosure, the laser printer 1 has been exemplified. However, this disclosure is not limited thereto. For example, the image forming apparatus having the fuser unit 100 may be an LED printer which performs exposing with LEDs, a copy machine or a multi-function apparatus other than printers, or the like.

In the above-mentioned illustrative embodiment, the image forming apparatus for forming a monochrome image has been exemplified. However, this disclosure is not limited thereto. An image forming apparatus for forming a color image may be used.

What is claimed is:

1. A fuser unit comprising:

a cylindrical member that has flexibility;

a nip member that is disposed to slidingly contact an inner surface of the cylindrical member; and a backup member that is driven by a driving force and configures a nip region between the backup member and the cylindrical member on the nip member, wherein the cylindrical member includes folded-back portions formed at outer sides of a recording-sheet conveyance region in a recording-sheet width direction by folding back entire circumferences of both ends of the cylindrical member outward, wherein a contact surface of the folded-back portions contacting the backup member has concaves and convexes, the concaves and convexes configured by at least one cut-off portion provided to each of the folded-back portions, and wherein the cut-off portions are notches formed at inner edges of the folded-back portions in the recording-sheet width direction.

2. The fuser unit according to claim 1, wherein the notches are formed to not reach open ends of the cylindrical member.

3. The fuser unit according to claim 1, wherein the cut-off portions are arranged in a pitch, in which at least one of the notches is positioned at the nip region.

4. The fuser unit according to claim 1, wherein the cut-off portions of both sides of the folded-back portions are formed to face each other in the recording-sheet width direction.

5. The fuser unit according to claim 1, wherein the cylindrical member is folded so that spaces are formed between the folded-back portions and a main body of the cylindrical member facing the folded-back portions.

6. The fuser unit according to claim 1, wherein the notches are arranged in a circumferential direction of the cylindrical member.

* * * * *